US006371128B1

(12) United States Patent
Hsueh

(10) Patent No.: US 6,371,128 B1
(45) Date of Patent: Apr. 16, 2002

(54) HOLDER FOR COMPRESSING A FILTER OF A CIGARETTE

(76) Inventor: Ching Fang Hsueh, PO Box 82-144, Taipei (TW)

( * ) Notice: Subject to any disclaimer, the term of this patent is extended or adjusted under 35 U.S.C. 154(b) by 0 days.

(21) Appl. No.: 09/520,222

(22) Filed: Mar. 7, 2000

(51) Int. Cl.[7] ..... A24F 47/00; A24F 13/02
(52) U.S. Cl. ..... 131/270; 131/287
(58) Field of Search ..... 131/270, 187

(56) References Cited

U.S. PATENT DOCUMENTS 3,260,266 A * 7/1966 Miller
4,068,672 A * 1/1978 Guerra ..... 131/170 A
4,246,913 A * 1/1981 Ogden et al. ..... 131/171 A
4,275,745 A * 6/1981 Carosone ..... 131/270
5,178,165 A * 1/1993 DeFelice ..... 131/198.1

* cited by examiner

*Primary Examiner*—Christopher A. Fiorilla
(74) *Attorney, Agent, or Firm*—A & J

(57) ABSTRACT

A holder for compressing a filter of a cigarette includes a first portion having a cylindrical body having an axial through hole, the cylindrical body having an inner side formed with a semi-cylindrical recess, a first mouth piece hinged connected to an end of the cylindrical body and formed with a curved inner side which decreases in diameter from a top to a bottom thereof, the first mouth piece having two first engaging edges, a second portion having a second mouth piece and a semi-cylindrical portion at an end of the second mouth piece, the semi-cylindrical portion being configured to engage with the semi-cylindrical recess, the second mouth piece having two second engaging edges configured to engage with the first engaging edges of the first mouth piece, whereby when in use, a cigarette filter is inserted into the first portion and then the first mouth piece is engaged with the second mouth piece to compress the filter thereby decreasing the amount of nicotine and tars form passing therethrough.

4 Claims, 6 Drawing Sheets

HOLDER FOR COMPRESSING A FILTER OF A CIGARETTE

BACKGROUND OF THE INVENTION

1. Field of the Invention

This invention is related to a holder for compressing the filter of a cigarette and in particular to one which can compress a filter to one-fifth of its volume thereby decreasing the amount of nicotine and tars from passing therethrough.

2. Description of the Prior Art

As we all know, cigarettes contain chemical substances such as tar and nicotine which are harmful to the health and will be accumulated in the body. It has been reported that tobacco would cause smokers to have lung cancer if they have smoked for a long period of time. Hence, under the pressure of the government and some civil organizations, most cigarette manufacturers have printed warning such as "smoking is a health-risk" on the cigarette pack. However, once one smokes, it is difficult for one to stop smoking simply upon reading the warning on the cigarette pack. Thus, various filtering devices for reducing the amount of tar and nicotine into the body have been developed and sold on the market.

The filtering devices generally fall into two categories, i.e. the first one utilizes chemical substances and the second one a plurality of distorted fins to separate, absorb or discompose tar and nicotine from the cigarette.

However, the chemical substance of the first filtering device may be inhaled together with the smoke into the smoker's body thereby causing another kind of danger. In addition, such a filtering device is expensive and cannot be accepted by most smokers. The capability of the second filtering device for separating tar and nicotine from smoke will be decreased with time. As a consequence, the second filtering device will become useless and has to be discarded after a certain period of time thereby giving a burden to the smoker.

Therefore, it is an object of the present invention to provide a holder for compressing a cigarette filter which can obviate and mitigate the above-mentioned drawbacks.

SUMMARY OF THE INVENTION

This invention is related to a holder for compressing the filter of a cigarette and in particular to one which can compress a filter to one-fifth of its volume thereby decreasing the amount of nicotine and tars from passing therethrough.

According a preferred embodiment of the present invention, a holder for compressing a cigarette filter includes a first portion having a cylindrical body having an axial through hole, the cylindrical body having an inner side formed with a semi-cylindrical recess, a first mouth piece hinged connected to an end of the cylindrical body and formed with a curved inner side which decreases in diameter from a top to a bottom thereof, the first mouth piece having two first engaging edges, a second portion having a second mouth piece and a semi-cylindrical portion at an end of the second mouth piece, the semi-cylindrical portion being configured to engage with the semi-cylindrical recess, the second mouth piece having two second engaging edges configured to engage with the first engaging edges of the first mouth piece.

It is the primary object of the present invention to provide a holder which can compress the filter of a cigarette to one-fifth of its original volume thereby decreasing the amount of nicotine and tars from passing therethrough.

It is another object of the present invention to provide a holder for compressing the filter of a cigarette which is simple in construction and low in cost.

The foregoing objects and summary provide only a brief introduction to the present invention. To filly appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
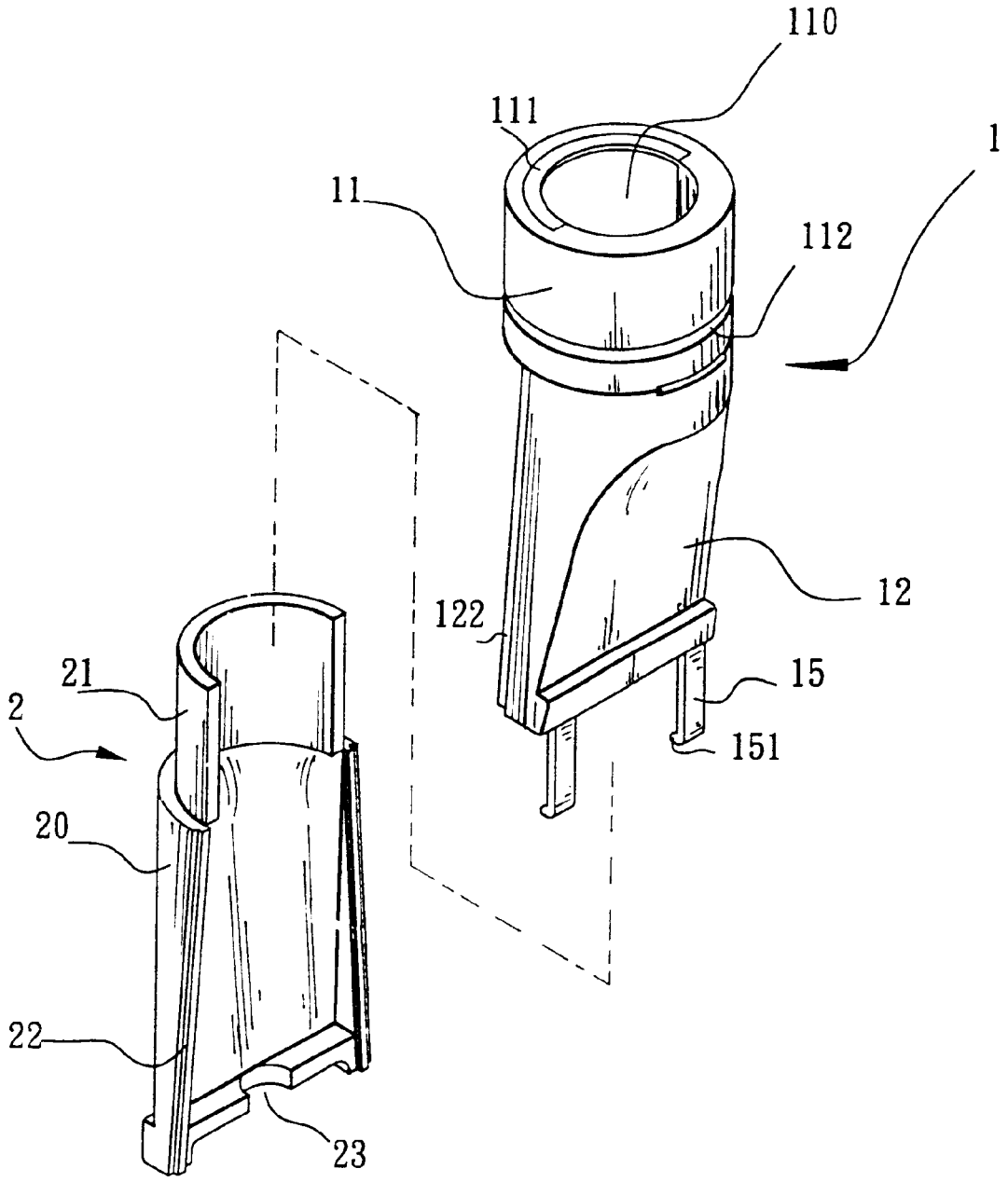
FIG. 1 is an exploded view of the present invention.
Figure 2:
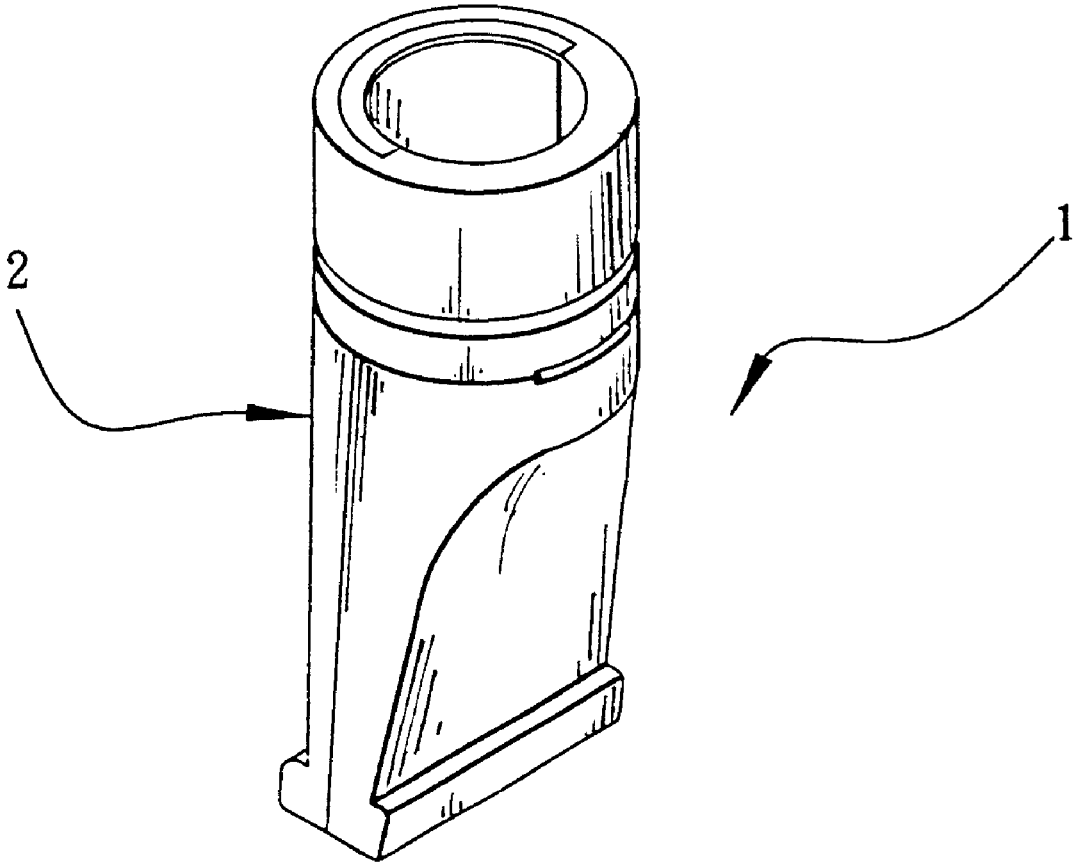
FIG. 2 is a perspective view of the present invention.
Figure 3:
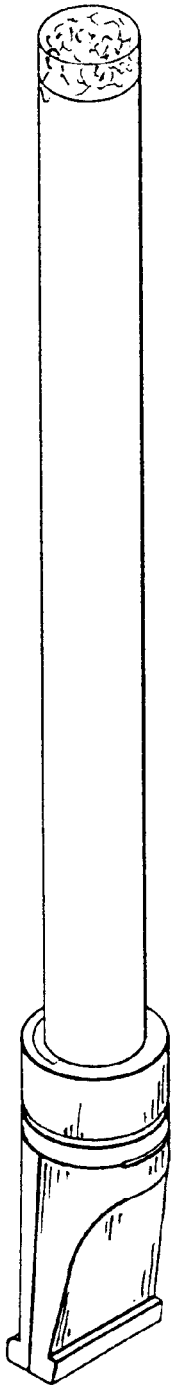
FIG. 3 illustrates how the holder is engaged with a cigarette.
Figure 4:
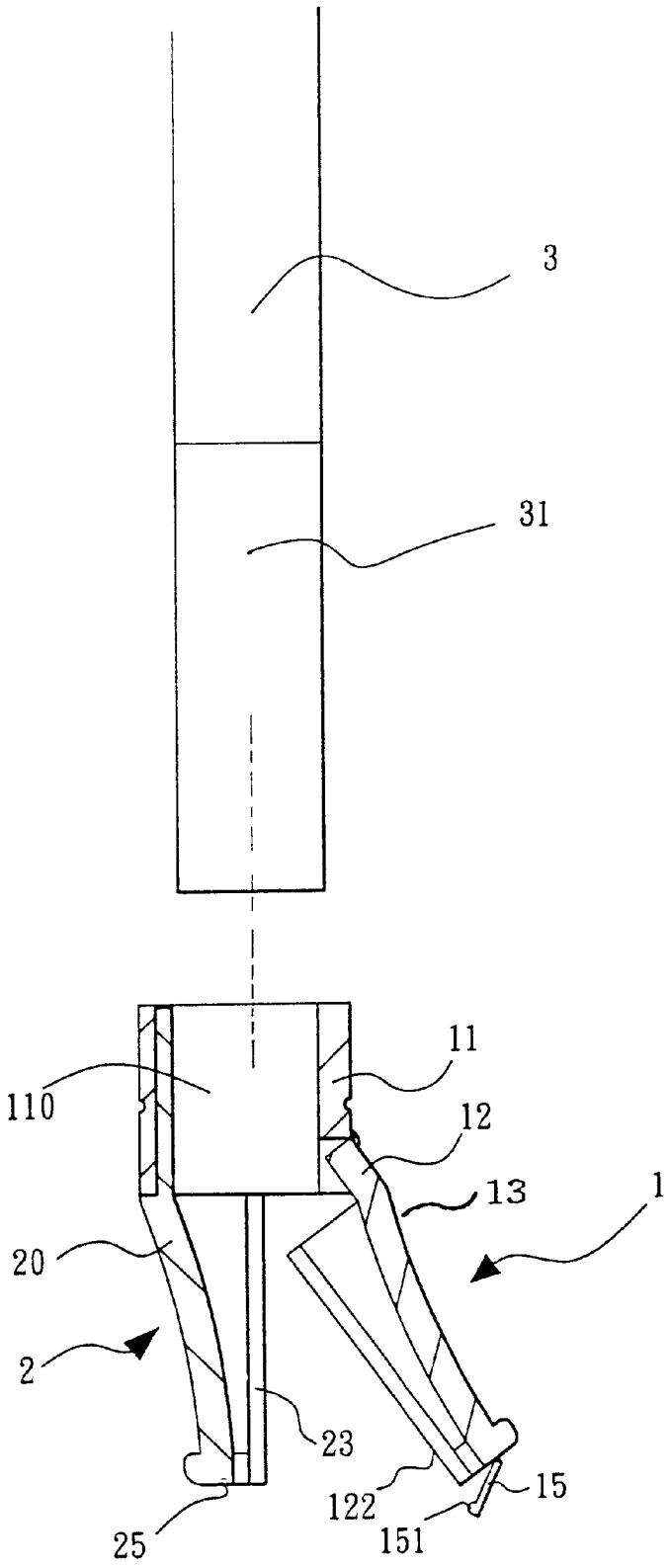
FIG. 4 illustrates the relationship between the holder and the cigarette.
Figure 5:
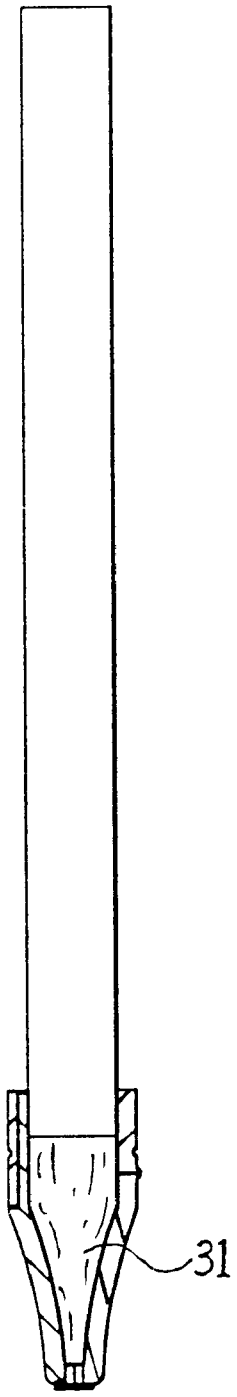
FIG. 5 is a sectional view illustrating the engagement between the holder and the cigarette.
Figure 6:
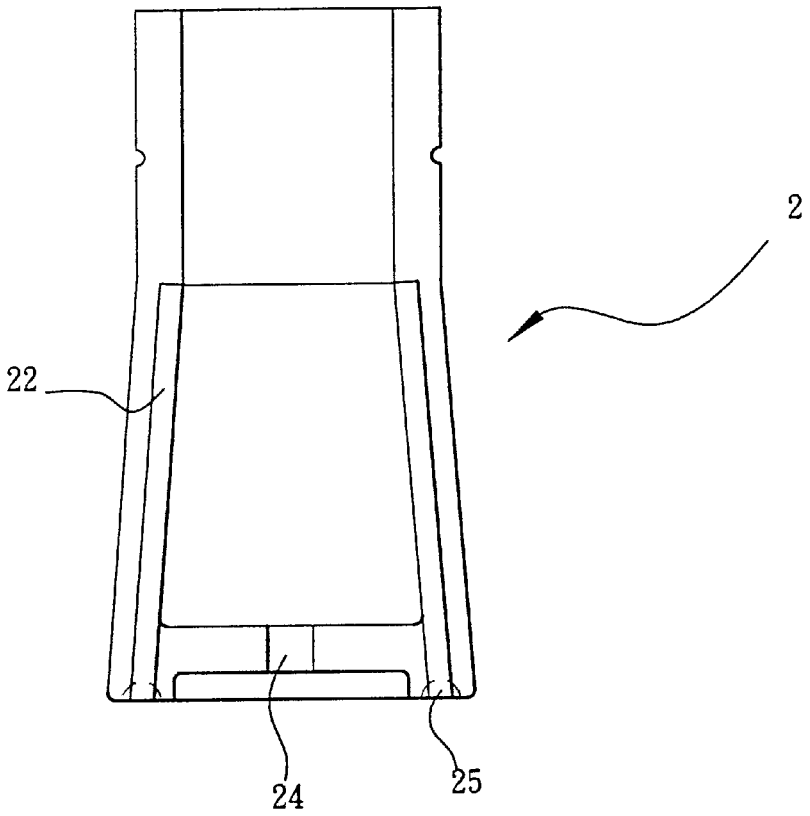
FIG. 6 is a sectional front view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIGS. 1, 2, 3 and 4 thereof, the holder according to the present invention generally comprises a first portion 1 and a second portion 2 engaged with the first portion 1.

Figure 7:
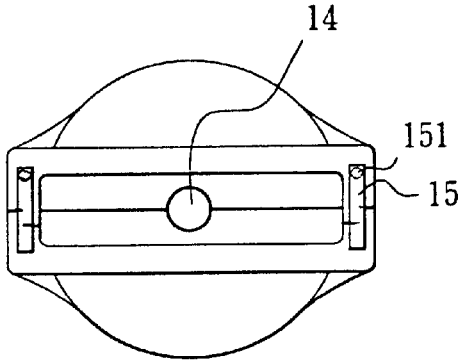
FIG. 7 is a top view of the present invention.

The first portion 1 is formed with a cylindrical body 11 having an axial through hole 110 for receiving a filter 31 of a cigarette 3 and a circular groove 112 on its outer surface. The cylindrical body 11 has an inner side formed with a semi-cylindrical recess. A first mouth piece 12 is connected to the bottom of the thicker portion of the cylindrical body 11 by a hinge 13 The hinge 13 is made of tough and flexible material such as plastic. The first mouth piece 12 is formed with two engaging portions 122 at two opposite edges thereof and a curved inner side which decreases in diameter from the top to the bottom. The lower end of the first mouth piece 12 is formed with a semi-circular hole 14 at the intermediate position. Two flexible lugs 15 each having a hook 151 at the lower end are provided on the bottom of the first mouth piece 12 (see FIGS. 4 and 7).

The second portion 2 has a second mouth piece 20 and a semi-cylindrical portion 21 at the upper end of the second mouth piece 20. The semi-cylindrical portion 21 is dimensioned to engage with the semi-cylindrical recess of the first portion 1. The second mouth piece 20 has two engaging portions 22 at two opposite edges thereof which are configured to engage with the engaging portions 122 of the first mouth piece 12 of the first portion 1. As the first mouth piece 12, the second mouth piece 20 is formed with a curved inner side which decreases in diameter from the top to the bottom and the lower end of the second mouth piece 20 is formed with a semi-circular hole 23 at the intermediate position. Furthermore, the lower end of the second mouth piece 20 is formed with two holes 25 configured to engage with the hooks 151 of the flexible lugs 15. In assembly, the semi-cylindrical portion 21 of the second portion 2 is inserted into the semi-cylindrical recess of the first portion 1 with the engaging portions 22 of the second mouth piece 20 snugly fitted with the engaging portions 122 of the first mouth piece 12, and then the circular cover 111 is engaged with the outer end of the semi-cylindrical recess of the first portion 1.

When in use, the first mouth piece 12 is first opened, the filter 31 of a cigarette 3 is inserted through the hole 110 until the filter 31 is stopped by the inner bottom of the second mouth piece 20, and the first mouth piece 12 is closed to engage with the second mouth piece 20. Thereafter, the hooks 151 of the flexible lugs 15 of the first mouth piece 12 are engaged with the holes 25 of the second mouth piece 20 thereby firmly engaging the first portion 1 with the second portion 2 and therefore compressing the filter 31 of the cigarette. By means of the present invention, the volume of the filter 31 may be compressed to ⅕ of its original thus enabling the filter 31 to effectively filter the nicotine and tar from the cigarette 3.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A holder for compressing a filter of a cigarette comprising:

a first portion having a cylindrical body having an axial through hole, said cylindrical body having an inner side formed with a semi-cylindrical recess, a first mouth piece hinged connected to an end of said cylindrical body and formed with a curved inner side which decreases in diameter from a top to a bottom thereof, said first mouth piece having two first engaging edges;

a second portion having a second mouth piece and a semi-cylindrical portion at an end of said second mouthpiece, said semi-cylindrical portion being configured to engage with said semi-cylindrical recess, said second mouth piece having two second engaging edges configured to engage with said first engaging edges of said first mouth piece;

whereby when in use, a cigarette filter is inserted into said first portion and then said first mouth piece is engaged with said second mouth piece to compress said filter thereby decreasing amount of nicotine and tars from passing therethrough.

2. The holder for compressing a filter of a cigarette as claimed in claim 1, wherein said cylindrical portion has an outer surface formed with a circular groove.

3. The holder for compressing a filter of a cigarette as claimed in claim 1, wherein said first mouth piece has a bottom provided with a plurality of flexible lugs having hooks at outer ends of said flexible lugs, and said second mouth piece has a bottom formed with a plurality of holes configured to engage with said hooks.

4. The holder for compressing a filter of a cigarette as claimed in claim 1, wherein said first mouth piece has a bottom formed with a first semi-circular hole, and said second mouth piece has a bottom formed with a second semi-circular hole associated with said first semi-circular hole to form a circular hole.

* * * * *